United States Patent [19]

Zaluski

[11] 4,227,728

[45] Oct. 14, 1980

[54] AUXILIARY LOCK ASSEMBLY

[76] Inventor: John Zaluski, 503 77th Ave. North, St. Petersburg, Fla. 33702

[21] Appl. No.: 56,454

[22] Filed: Jul. 11, 1979

[51] Int. Cl.[3] ..... E05C 13/02

[52] U.S. Cl. ..... 292/297

[58] Field of Search ..... 292/258, 288, 297, 153, 292/342, 343, 150; 70/14

[56] References Cited

U.S. PATENT DOCUMENTS

| | | | |
|---|---|---|---|
| 95,231 | 9/1869 | Jones | 292/288 |
| 2,019,789 | 11/1935 | Mahonnah | 292/258 X |
| 2,492,322 | 12/1949 | Russell | 292/153 X |
| 4,189,176 | 2/1980 | Hamilton | 292/153 |

*Primary Examiner*—Richard E. Moore
*Attorney, Agent, or Firm*—Arthur W. Fisher, III

[57] ABSTRACT

A portable, auxiliary lock assembly of the type used to secure the conventional or permanently installed lock bolt in its locked position thereby preventing inadvertent admittance through the use of a key or through unauthorized manipulation of the lock mechanism itself. A pair of clamp arms are spaced between the door frame and the edge of the door containing the locking assembly and disposed into firm grasping engagement with the portions of the lock bolt when it is in its locked position. Movement of the lock bolt into its unlocked position is thereby prevented until such bolt is released by the clamp arms of the auxiliary lock assembly.

10 Claims, 9 Drawing Figures

AUXILIARY LOCK ASSEMBLY

BACKGROUND OF THE INVENTION

1. Field of the Invention

This invention relates to an auxiliary lock assembly of the type having oppositely disposed clamp arms having grasping portions thereon for frictionally and firmly engaging or grasping a lock bolt while it is maintained in its locked position between the door edge and the frame of the door whereby movement of the lock bolt along its own longitudinal axis either through the use of a key or through "picking" of the lock is prevented.

2. Description of the Prior Art

The existence of portable and/or auxiliary locking assemblies have been known for some time. Such assemblies are frequently used to insure unauthorized entry into a room or location during travel, etc. Typically, such assemblies are secured to some portion of the conventional, permanently installed locking means or door knob for the purpose of preventing entry into a given room or the like through the use of a key or by means of "picking" the conventional lock.

While such prior devices have been known for some time, numerous of such devices typically are overly complicated, generally burdensome and difficult to install and frequently are not adaptable to a wide variety of conventional locks normally found in hotels, motels, or semi-private dwellings.

Prior examples of such auxiliary or portable locking structures are disclosed in the following U.S. Pat. Nos.: Weingart, 3,475,929; 3,451,235; 3,429,151, 3,416,333; and Oldham, 1,168,107.

The variance in design of such structures evidences the fact that the problem has long existed in the prior art and has been attempted to be solved through the production and/or design of numerous auxiliary lock assemblies having varied design configurations.

It can also be readily assumed that the lack of commercial availability of such structures in current times is evidence of the fact that practical problems could very well have existed which made such type prior art structures undesirable or not feasible in every day operation or usage.

Accordingly, there is still a need in the industry for a portable, auxiliary, lightweight locking assembly capable of preventing the opening of various closures such as door which is used as a supplement to conventional locking structures normally associated with conventional door closures, etc.

SUMMARY OF THE INVENTION

This invention relates to an auxiliary lock assembly comprising two clamp arms pivotally at ached to one another along some part of their length and further including grasping means having roughened peripheral edges oppositely disposed and correspondingly positioned as as to frictionally engage opposite outer surface portions of a conventional lock bolt. Grasping of the lock bolt in such a fashion eliminates the possibility of its movement along its own longitudinal axis. Accordingly the thickness of the clamp arms are of sufficient dimension to fit between the edge of the door and the frame wherein the lock bolt may be frictionally grasped thereby limiting the possibility of it being removed from its locking position. This is true whether the conventional lock assembly of which the lock bolt is a part, is attempted to be manipulated by a key or by any other device such as burgularly tools.

The grasping means are located essentially at one end of the correspondingly positioned spaced apart clamp arms and these portions are movable towards and away from one another so as to secure engagement of the grasping means on oppositely disposed portions of the lock bolt as described above. A closing means is interconnected between the two clamp arms and includes a bracket attached to one of the clamp arms designed to move along the length of a finger element having its opposite end attached to the opposite of the two clamp arms. By virtue of this arrangement, a lock nut is provided so as to position the bracket along predetermined points on the length of the finger thereby securing a firm and substantially "locked" engagement of the grasping means of each clamp arms with the outer, oppositely disposed surfaces of the lock bolt.

Various embodiments of the lock assembly of the present invention include the pivot means located at one end of the clamp arm in interconnected relation thereto relative to the grasping means located at the opposite end thereof wherein the closing means is located therebetween. Alternately, the closing means may be located at one distal end at interconnecting relation between oppositely disposed distal ends of the two clamp arms wherein the pivot means is located in substantially the center portion thereof so as to cause movement of the grasping means of each clamp arm towards and away from one another in grasping fashion relative to the lock bolt.

Yet another embodiment of the present invention comprises the two clamp arms being disposed in co-planar relation relative to one another wherein the length of each oppositely disposed clamp arm may be substantially linear or alternately may be angular. This latter defined angular configuration is provided so as to allow adequate fitting of both clamp arms in the space between the edge of the door and the door frame when it is intended to fit the clamp arms on either side of the door or to avoid interference with a strike plate normally associated with conventional lock assemblies.

Along these lines a wedge plate element is provided of thickness at least as great as the clamping arms and having a sufficient thickness dimensioned so as to fit between the edge of the door and the door frame in a manner so as to force the enlargement of such space thereby providing access of the clamp arms into said space for gripping of the lock bolt therebetween. Accordingly, the auxiliary lock assembly of the present invention accomplishes the purpose of prohibiting unauthorized entry into a room through the door or like closure through utilization of a structure which is of simple design, long life and durable construction. In addition, the assembly is structured so as to not damage any existing portions of the door or door frame or cause damage to the lock bolt or other portions of the locking assembly or handle assembly associated with conventional doors.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
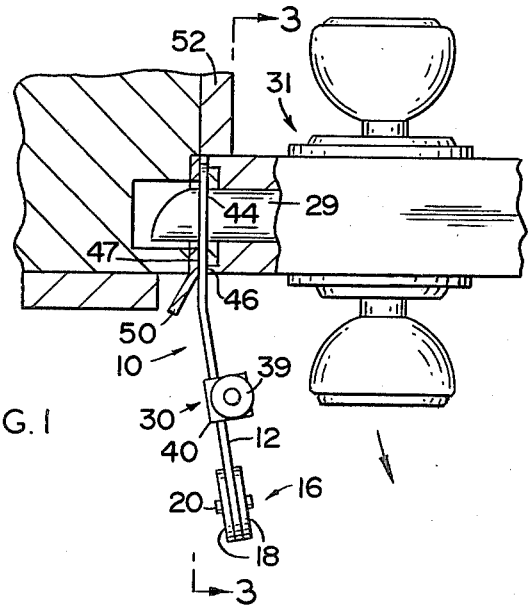
FIG. 1 is a top sectional view showing the interior workings of the clamp arms relative to the lock bolt.

As shown in FIGS. 1 through 4, 6 and 7 the auxiliary lock assembly of the present invention is generally indicated as 10 and includes two clamp arms 12 and 14 interconnected at least at some point by a pivot means generally indicated as 16. In the embodiments of FIGS. 1, 2, 3 and 4 the pivot means 16 comprises interconnecting lengths 18 disposed in pivoted attachment at their opposite ends to clamp arms 12 and 14. Accordingly each of the clamp arms 12 and 14 are pivotally movable relative to the length elements 18 by virtue of the pivot access 20 and 21.

Figure 6:
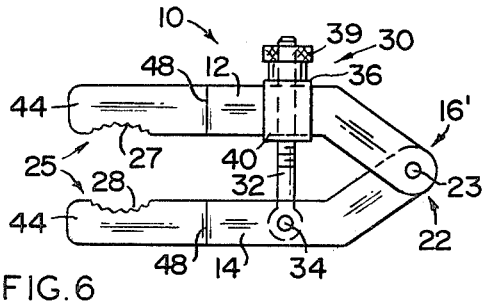
FIG. 6 is a side view of another embodiment of the present invention.
Figure 7:
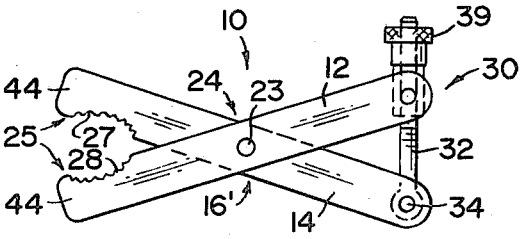
FIG. 7 is a side view of yet another embodiment of the present invention.

With regard to FIGS. 6 and 7 the embodiments therein shown includes pivot means 16' including a single pivot access 23 wherein a pivot pin is interconnecting the distal ends as at 22 (FIG. 6) and the mid portion as at 24 (FIG. 7).

Irrespective of the embodiment of the pivot means utilized, the clamp arm 12 and 14 each have grasping means 25 integrally formed thereon which are capable of moving towards and away from one another by virtue of the pivotal interconnection as provided by the pivot means 16 or 16'.

The grasping means themselves are in the shape of substantially uneven, roughened, or serrated interior edge portions 27 and 28 disposed in spaced apart relation from one another and specifically configured to grasp and be frictionally secured to opposite outer surface portions of the lock bolt 29 normally associated with conventional lock assemblies generally indicated as 30.

Specific purpose and operation of the grasping means relative to their engagement with the lock bolt 29 will be explained in greater detail hereinafter when the description is made as to the operational characteristics of the structure of the subject invention.

Figure 5:
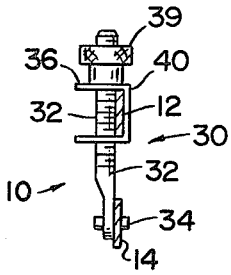
FIG. 5 is an end sectional view of the closing means taken along line 5—5 of FIG. 3.

The lock assembly of the present invention further comprises a closing means generally indicated as 30. The closing means includes a finger 32 having one end pivotally attached as at 34 to one of the clamp arms 14 and extending into inter engagement with the other of the clamp arms 12. More specifically the closing means includ a bracket element 36 threadly attached to point or points along the length of the finger element 32 as best shown in FIG. 5. This is due to the exterior threaded surface 37 of the finger element. A closing nut 39 is secured to the top surface as at 40 of the bracket 36. This nut 39 is internally threaded in the normal fashion so as to allow movement along the length of the finger element 32 and the exterior threaded portion 37. This in turn of course moves the bracket along the length of finger element 32. The bracket 36 is secured to one of the clamp arms 12 by being disposed in surrounding relation thereto. Accordingly, movement of the bracket along the length of the finger 32 causes movement of the arm 12 towards and away from the arm 14 due to the interconnection of the closing means between the arm 12 and 14. This of course in turn causes frictional engagement of the grasping means as at 27 and 28 to the outer surface of the lock bolt 29.

Figure 2:
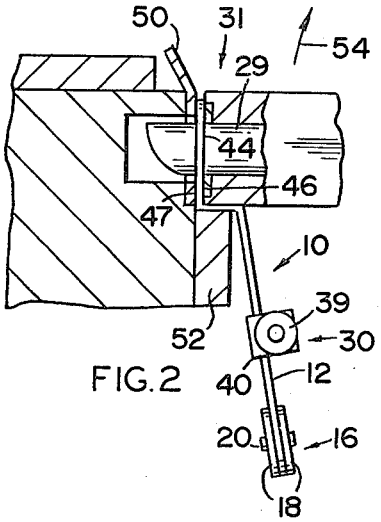
FIG. 2 is another embodiment of the auxiliary lock assembly of the present invention with an angular, longitudinal configuration.

When the lock bolt is in its locking position as shown in FIGS. 1 and 2, and the grasping means are engaged thereabout (FIG. 3) the lock bolt 29 is prevented from moving along its own longitudinal axis into its non lock position. This is due to the fact that the ends or portions 44 of each clamp arm 12 and 14 are specifically disposed in the space between the door edge 46 and the corresponding edge of the door frame 47.

Figure 3:
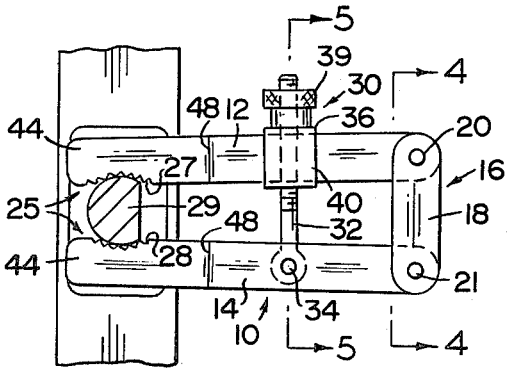
FIG. 3 is a sectional side view taken along line 3—3 of FIG. 1.
Figure 4:
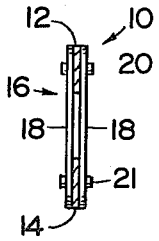
FIG. 4 is an end section view taken along line 4—4 of FIG. 3.

In one embodiment of the present invention the longitudinal configuration of the clamp arms while arranged in co-planar relationship to one another (FIGS. 1 and 2) is angular along at least one part. This angular orientation is defined by a fold or bend line 48 (FIGS. 3 and 6). This angular orientation serves to eliminate interference with a strike plate 50 normally associated with most lock assemblies. Similarly relative to the embodiment of FIG. 2 the clamp arms include a more severe angular orientation so as to overcome the jam portion 52 when the lock assembly 10 is positioned on the opposite side of the door relative to the direction in which it opens as indicated by directional arrow 54.

Figure 8:
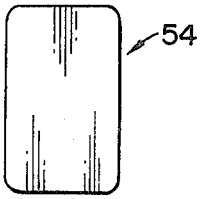
FIG. 8 is a front view of the wedge plate means of the present invention.
Figure 9:
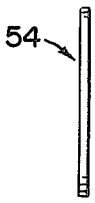
FIG. 9 is an end view of the embodiment of FIG. 8.

Relative to the embodiments of FIGS. 8 and 9 a wedge plate 54 is generally indicated and provided with a transverse dimension (FIG. 9) somewhat greater than the thickness of each of the clamp arms when they are arranged in co-planar relationship to one another. The thickness of the wedge plate 54 is such as to be fitted between the edge 46 of the door and the corresponding edge 47 of the door frame so as to enlarge the space, when necessary, for the proper insertions of portions 44 of the clamp arms 12 and 14. This will allow proper positioning of the grasping means 25 about the exterior surface of the lock arm 29.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An auxiliary lock assembly primarily designed to prevent longitudinal displacement of a conventional lock bolt element, said assembly comprising: frame means dimensioned and configured for placement between door edge and a door frame and including two clamp arms movably interconnected to one another, each clamp arm comprising grasping means formed on correspondingly positioned interior edge portion of each arm in spaced apart relation to one another, closing means interconnected to each clamp arm and disposed to position said clamp arms into and out of grasping engagement with oppositely disposed external surface portions of the lock bolt element, whereby movement of the lock bolt along its own longitudinal axis and into a non-locking position is prevented.

2. An auxiliary lock assembly as in claim 1 wherein said clamp arms are disposed, at least in part, in substantially co-planar relation to one another and dimensioned and configured for placement between the door edge and door frame, said grasping means positionable in functional engagement with the lock bolt.

3. An auxiliary lock assembly as in claim 2 wherein portions of each of said clamp arms having said grasping means formed thereon are positioned in co-planar spaced apart relation to one another and in angularly oriented relation to remaining portions of each clamp arm.

4. An auxiliary lock assembly as in claim 2 wherein portions of each of said clamp arms having said grasping means formed thereon are positioned in co-planar spaced apart relation to one another, the longitudinal axis of each clamp arm including a multi-angular configuration.

5. An auxiliary lock assembly as in claim 1 further comprising pivot means movably interconnected between each of said clamp arms and disposed in spaced apart relation from said grasping means and said closing means, and further disposed to cause displacement of each grasping means toward and away from one another upon manipulation of said closing means.

6. An auxiliary lock assembly as in claim 5 comprising a length element having oppositely disposed ends pivotally attached to one of said clamp arms and disposed opposite said closing means relative to said grasping means.

7. An auxiliary lock assembly as in claim 1 wherein each of said grasping means comprises adetent portion integrally formed in correspondingly positioned interior edge portions and each further including a substantially uneven periphery disposable in frictional engagement with oppositely disposed external surface portions of the lock bolt.

8. An auxiliary lock assembly as in claim 1 wherein said closing means comprises a finger element movably attached to one of said clamp arms, bracket means secured to the opposite of said clamp arms and movably mounted on said finger for disposition along the length thereof, whereby movement of said bracket along the length of said finger causes pivotal movement of said clamp arms relative to one another and disposition of said grasping means towards and away from one another.

9. An auxiliary lock assembly as in claim 8 wherein said bracket includes a nut means and said finger comprises an externally threaded surface having said nut means movable along the length thereof.

10. An auxiliary lock assembly as in claim 1 further comprising wedge plate means having a thickness at least as great as leading portions of both clamp arms on which said grasping means are formed, said wedge plate means disposable between a door edge and the door jam, whereby space is provided for similar placement of said clamp arms.

* * * * *